United States Patent [19]

Rossi

[11] Patent Number: 4,964,761

[45] Date of Patent: Oct. 23, 1990

[54] RETAINING WALL ADAPTED TO BE PROVIDED WITH VEGETATION, COMPRISING OPENINGS SERVING AS A CONCEALED FRAMING FOR CONCRETE

[76] Inventor: Jean-Louis Rossi, Le Grand Pin de Righi, 25 rue Georges Doublet, 06100 Nice, France

[21] Appl. No.: 417,249

[22] Filed: Oct. 2, 1989

[30] Foreign Application Priority Data

Sep. 30, 1988 [FR] France ..... 88 12938

[51] Int. Cl.[5] ..... E02D 29/02

[52] U.S. Cl. ..... 405/286; 405/273; 405/284; 52/606; 47/83

[58] Field of Search ..... 405/262, 272, 273, 284, 405/286; 52/606, 169.4; 47/83

[56] References Cited

U.S. PATENT DOCUMENTS

| | | | |
|---|---|---|---|
| 1,495,439 | 5/1924 | Reagan | 52/606 X |
| 2,514,536 | 7/1950 | Burney . | |
| 4,229,123 | 10/1980 | Heinzmann | 405/273 |
| 4,671,706 | 6/1987 | Giardini | 405/286 |
| 4,707,962 | 11/1987 | Meheen | 405/273 X |
| 4,802,320 | 2/1989 | Forsberg | 52/585 |

FOREIGN PATENT DOCUMENTS

| | | | |
|---|---|---|---|
| 0013535 | 7/1980 | European Pat. Off. . | |
| 3247030 | 6/1984 | Fed. Rep. of Germany | 47/83 |
| 3303144 | 8/1984 | Fed. Rep. of Germany . | |
| 3538659 | 5/1987 | Fed. Rep. of Germany . | |
| 2184323 | 12/1973 | France . | |
| 2561684 | 9/1985 | France | 47/83 |
| 2604859 | 4/1988 | France . | |
| 657172 | 8/1986 | Switzerland . | |

*Primary Examiner*—Randolph A. Reese
*Assistant Examiner*—John A. Ricci
*Attorney, Agent, or Firm*—Young & Thompson

[57] ABSTRACT

Dry-mounted construction elements, each of the type constituted by a bottomless container comprising vertical partitions, a first vertical partition, parallel to the front wall of the container, delimiting a large front space (5), which serves as a flower pot and at least one rear space (6) which serves as a root cavity for the upper container and which is offset rearwardly from the lower container, this latter space (6) being divided in at least two smaller spaces (7, 8) by a second vertical partition (4) perpendicular to the front wall and to the first partition. The construction element has a rear portion which has a notch (10) disposed on each upper side edge of the container, and two small cavities or spaces (14, 15) behind the notches. A wall built of these elements is useful as a retaining wall, flower box, or noise barrier.

5 Claims, 12 Drawing Sheets

RETAINING WALL ADAPTED TO BE PROVIDED WITH VEGETATION, COMPRISING OPENINGS SERVING AS A CONCEALED FRAMING FOR CONCRETE

The invention has as its object a construction element for retaining walls intended to be provided with vegetation, comprising openings serving as a concealed framing for concrete.

The creation of larger and larger excavations for making or enlarging highways requires the creation of retaining walls. These walls are awkward and unsightly. Preservation of the environment requires providing vegetation on retaining walls.

These retaining walls may be used by private individuals, as well as by professionals (bridges and highways, rural engineering, landscapers, departments of public works, cultivators, etc.)

There already exist construction elements. These elements serve as containers, which are coffers having a significant open space so that shrubs or covering plants may grow therein. These elements are dry mounted by fitting them together in one another.

Other elements have the form of a cavity which prevents the too rapid evacuation of water. The exterior shape was designed also to provide a sound barrier. Filling of these elements or containers with dirt is done during assembly of the construction elements. Due to their coffer shape, these elements produce a linkage in the assembled retaining wall.

The construction elements described above are made from flower pots, which are dry mounted and assembled in one another to form a retaining wall. This type of retaining wall is more or less fragile, depending on the slope of the hill or the excavation, the climate, etc. The plants have a decorative function to cover the wall, but they do not cooperate in any manner with the construction elements and the soil to improve the stability of the said wall.

The invention tends to overcome these problems. The plants act on the retaining wall which is anchored by the roots of the plants in the soil, the roots of the plants also intertangling from one construction element to another, thereby improving the interconnection of the said elements.

The invention is an improvement of the construction element described in French patent No. 2,561,684. The construction element for dry mounting of retaining walls, intended to be provided with vegetation, is constituted by a bottomless container and is characterized by the fact that the vertical partitions are disposed so as to delimit a large front space which serves as a flower pot, and at least two smaller rear spaces which serve as root cavities.

The construction element for dry mounting of retaining walls, adapted to be provided with vegetation, of the bottomless container type whose vertical partitions delimit spaces, is characterized by the fact that the front part of the said container has a trapezoidal shape for lightening the element forwardly, and weighing down the rear rectangular portion. The vertical partitions are disposed so as to delimit a large space forwardly which serves as a flower pot, and at least two smaller rearward spaces which serve as root cavities. The size of the small rearward spaces is such that when the containers are superposed on one another, the roots which exit from the upper container may pass only into the soil and not into the lower container, that is the vertical partition of the upper container extends to the level of the rear wall of the lower container; the said vertical partition is parallel to the rear wall of the said container.

These characteristics permit rapid growth of vegetation; the roots become anchored in the embankment behind the wall. A fabric of roots is thus created, thereby considerably increasing the resistance of the elements to pressure.

The state of the art may be defined by the following patents:

French patent No. 2,422,774; European patent application No. EP-A-0047717; German application No. DE-A3,003,434. All these patents describe construction elements, but the construction elements described therein do not have a large forward space and at least two smaller rearward spaces.

Only the document CH-A-612,239 describes a construction element divided in two chambers, a forward chamber and a rearward chamber.

The construction element according to the invention is an improvement to the construction element described in the basic French patent No. 2,561,684. This construction element, referred to as a heavy element with respect to the basic element called the light element, enables construction of very high retaining walls (for example of 8 to 10 meters) but which can be built by a single worker without special equipment or tools. The angle of inclination is modified since the ratios of length to width are different.

The light element or the heavy element, according to the invention, was studied to offset one pressure by another pressure, thanks to these technical characteristics. The light element, for example, may with a weight less than 25 kg, be considered as the first weight.

The heavy element comprises supplementary cavities or spaces which permit supplementary vegetation, causing the roots to penetrate into three or four lower elements.

A reserved portion of the cavities thus formed serves as a concealed casing for concrete, which allows the creation of reinforced retaining walls where extreme pressures so require.

The heavy element according to the invention is formed on the one hand from the light element in its forward portion, one of whose characteristics is its trapezoidal shape, and on the other hand by a complementary element in the rear portion. The light element is composed of a bottomless container whose first vertical partition delimits a large forward space and a small rear space. This vertical partition is parallel to the partition of the container. The rear space is itself subdivided into two small spaces by a second vertical partition perpendicular to the first. This element extends in a bottomless container which comprises a slot at the level of its side edges, thus forming a horizontal recess.

A vertical median wall in the extension of the second vertical wall forming the two small spaces separates into spaces the said container. This second vertical wall continues beyond the slot so as also to divide in two other small spaces or cavities the terminal rear portion of the construction element.

The assembly composed of the light element and the complementary element forms the heavy element.

When made in much larger dimensions, with a much greater weight, the heavy element can be used to reinforce the banks of rivers and lakes.

According to another embodiment, the terminal rear portion of the complementary element instead of being divided in two additional small spaces or cavities, may simply be solid. This embodiment contributes toward the lightening of the element forwardly (trapezoidal) and the weighing down on its rear portion.

According to another embodiment, the construction element may allow for the construction of curves. To this end, the side walls may form a curve. The construction element, permitting the construction of curves, has a height less than the value of the notches situated in the lower portion.

The retaining wall, designed to be provided with vegetation, is constituted by construction elements that are dry mounted, by fitting together in one another, and by superposition on one another. Each light element is of the type constituted by a bottomless container comprising vertical partitions. A first vertical partition, parallel to the front wall of the container, delimits a large forward space, which serves as a flower pot and, at least one rearward space, which serves as a root cavity for the upper container mounted recessed therefrom, offset rearwardly from the lower container, this latter space being divided in at least two smaller spaces by a second vertical partition, perpendicular to the front wall and to the first partition. The size of the rearward spaces is such that when the containers are superposed on one another, the roots which exit from the upper container may pass only into the soil and not into the lower container, that is to say the vertical partition of the upper container extends to the level of the rear wall of the lower container. The construction element is composed of a light element and comprises a complementary element which forms the rear part of the said construction element and which forms, in addition to a notch disposed on each edge of the container, two small spaces or cavities which allow supplementary vegetation.

The complementary element, which forms the rear part of said construction element, is extended by a notch on each edge of the container forming a horizontal recess. A vertical median wall in the extension of the second vertical wall delimits two cavities or spaces which serve as a concealed framing for concrete. Beyond the notch, a vertical wall, extending the vertical walls, forms two small spaces or cavities.

At the level of the lower edges, there is a front notch and another large notch in the median portion of the bottomless container.

The special cavities serve as a concealed framing for reinforced or non-reinforced concrete pillars.

The horizontal recess formed by the notch permits the positioning of a reinforced or non-reinforced beam.

The most rearward cavities are suppressed.

The longitudinal walls form two parallel curves.

The rear portion is solid so as to reinforce the lightening of the forward trapezoidal element and the weighing down on the rear portion.

The heavy element (light element plus complementary element) comprises, as its only interconnection means, an upper receiving notch in the front truncated portion.

The heavy element (light element plus complementary element) comprises a complementary element rearwardly which is directly associated with the light element (from below) without any notch between the two elements.

The construction element is constituted by two adjacent containers called light elements, fabricated as a single block. The two exterior vertical side walls of the said element are concave.

The construction element may be associated with a special element for constructing a curve, the said element having convex exteriors vertical side walls.

A construction element may be constituted from a heavy element and an adjacent light element fabricated as a single block, the exterior vertical wall of the light element being concave.

The accompanying drawings are given by way of explanatory and non-limiting example. They show a preferred embodiment according to the invention. They will allow a ready understanding of the invention.

FIG. 6 shows another embodiment where all the technical characteristics are shown, except the general parallelepiped shape, but where the longitudinal walls form two parallel curves and where the rear portion of the element is solid.

a side view (FIG. 14) of a light element with its upper connecting means, a view from above (FIG. 15) showing elements offset from and non-adjacent to one another, a side view (FIG. 16) of several assembled elements.

Figure 17:
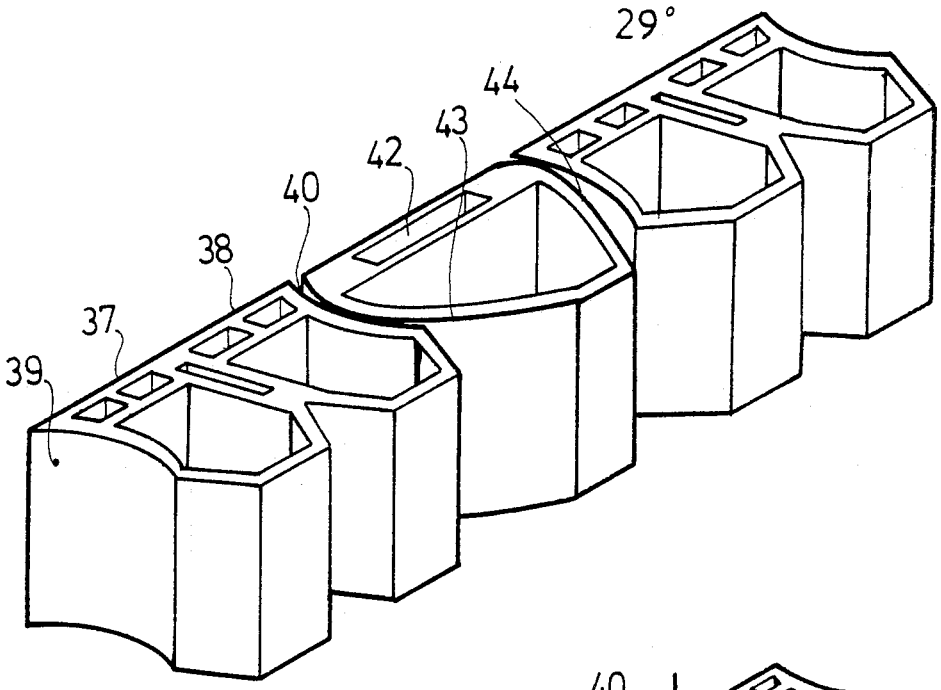

FIG. 17 is a view of the association of a construction element (heavy or light) whose exterior vertical side walls are concave, with the special element whose exterior vertical side walls are convex. This association may form a flower box.

Figure 18:
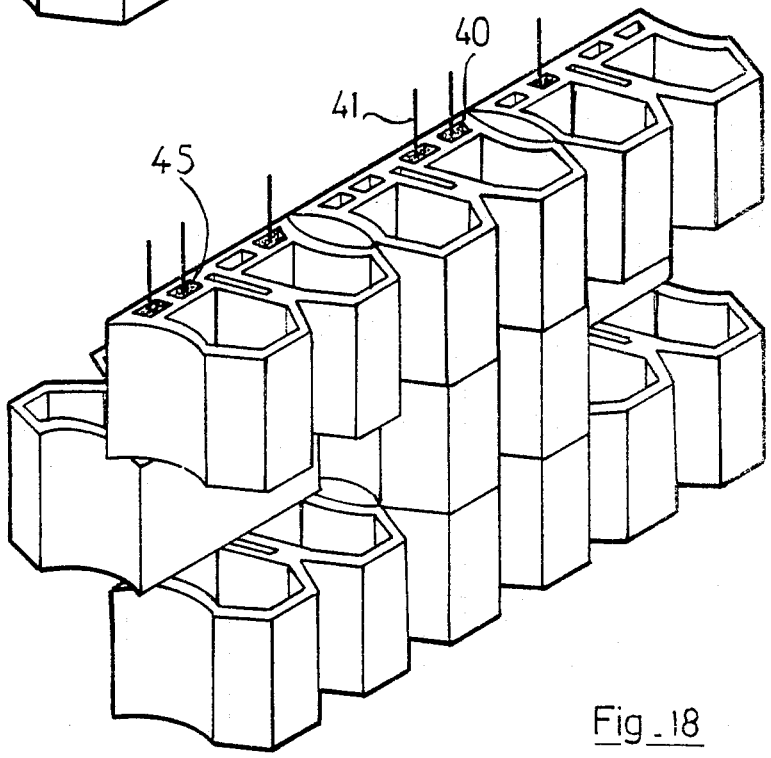

FIG. 18 is a flowered enclosing wall with flower pots alternating on both sides.

Figure 19:
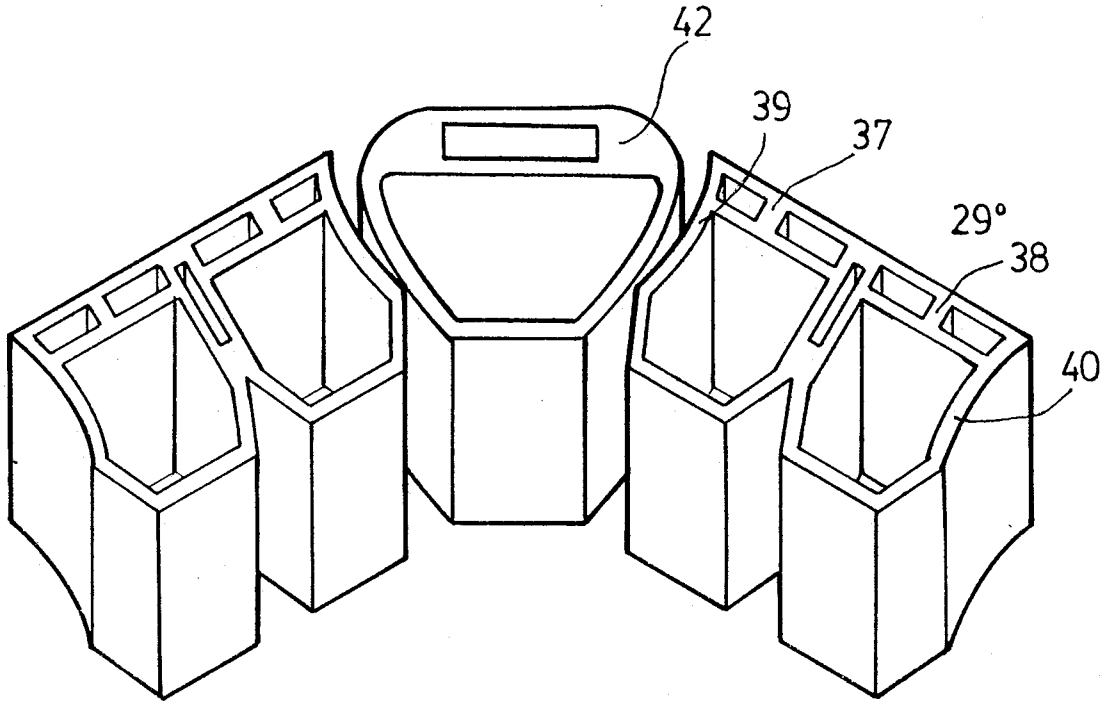

FIG. 19 is a view of the association of elements such as shown in FIG. 17, but where the angle is open.

Figure 20:
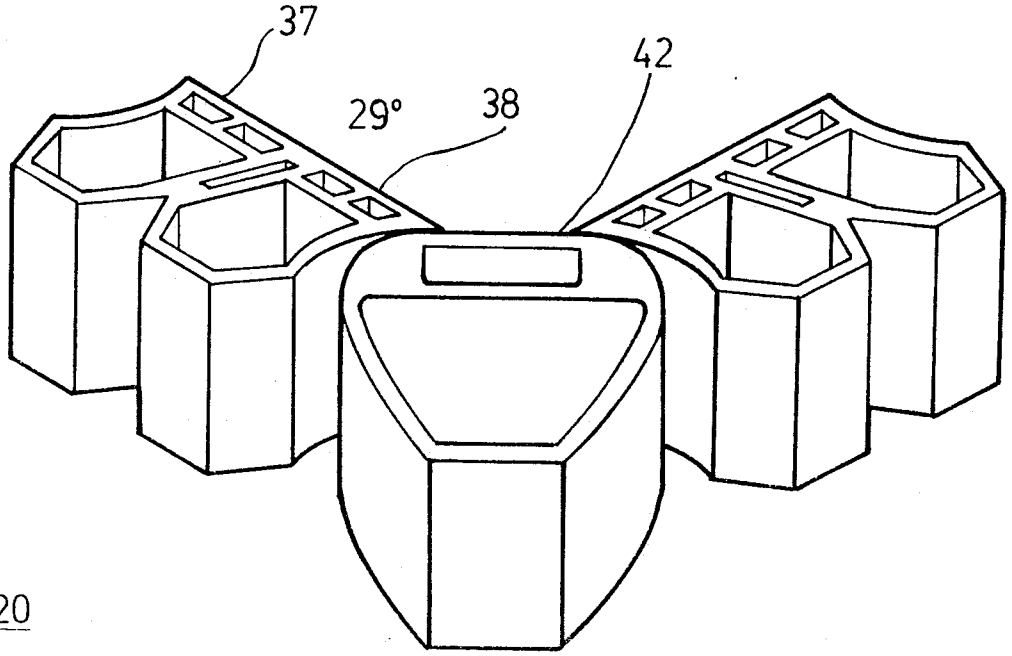

FIG. 20 is a view of the association of elements such as shown in FIG. 17, but where the angle is closed.

Figure 21:
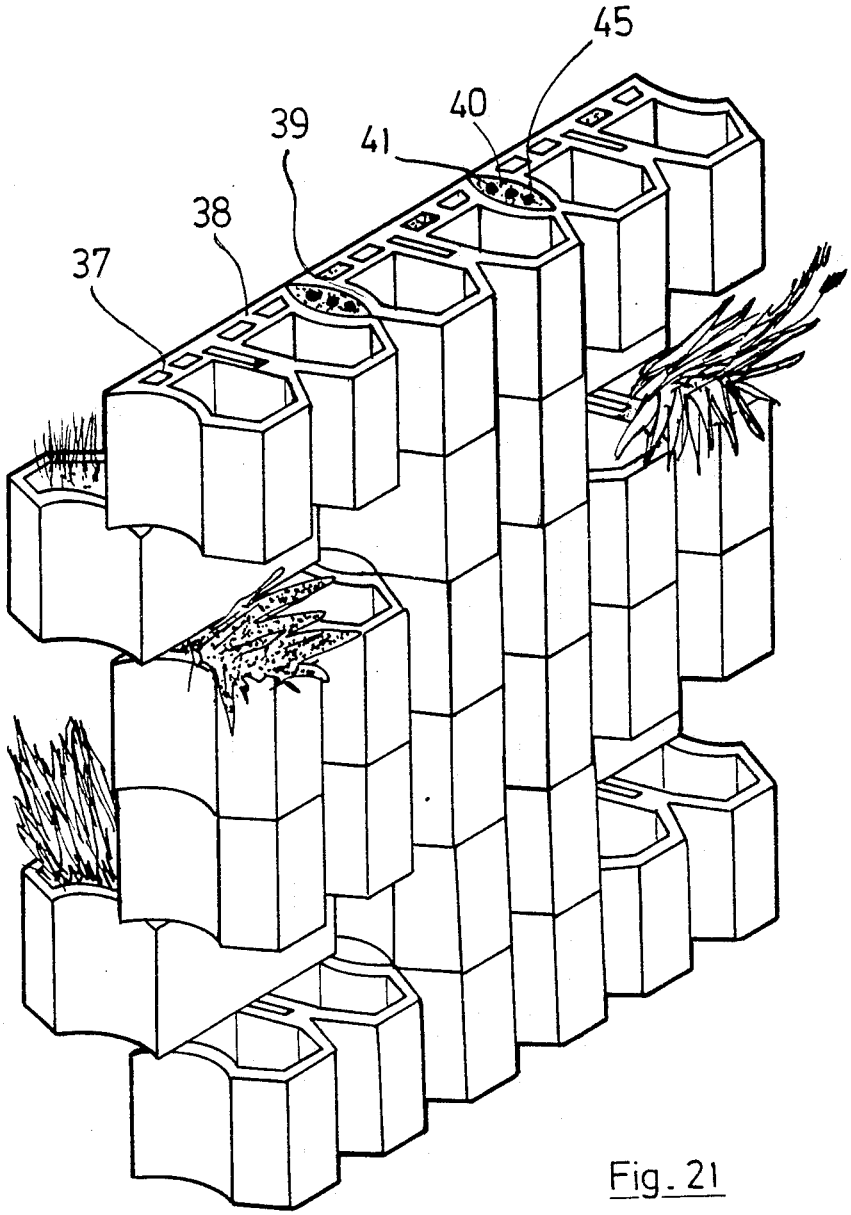

FIG. 21 shows a vertical barrier on which vegetation may be grown, forming a vertical sound barrier.

The heavy element 1 is generally a pre-fabricated element of mixed concrete.

It is composed of a single bottomless container whose front part comprises all the characteristics of the light element, namely a parallelepiped rectangle whose angles 2, 3 are truncated in the front part; a vertical partition 4 that separates the said container in two parts, a large space 5 and a small space or cavity 6 itself separated in two small spaces 7 and 8 by another vertical partition 9 perpendicular to the first vertical partition 4.

The rear part is extended by a notch 10 on each upper side of the container and serves as a horizontal recess for a reinforced or non-reinforced beam 23, whereas the interior of the said container comprises two cavities 11, 12, separated by a vertical wall 13, and two other cavities 14, 15, separated by a vertical wall 16, which extend the vertical wall 13. These two cavities 11, 12 serve as a concealed framing for reinforced or non-reinforced concrete pillars 24.

According to another embodiment, not shown in the drawings, the most rearward cavities 14, 15 may be suppressed.

At the level of the lower edges, there is a front notch 17 and another large notch 18 in the median portion of the bottomless block. These notches 17, 18 permit interfitting of the elements on one another.

Figure 3:
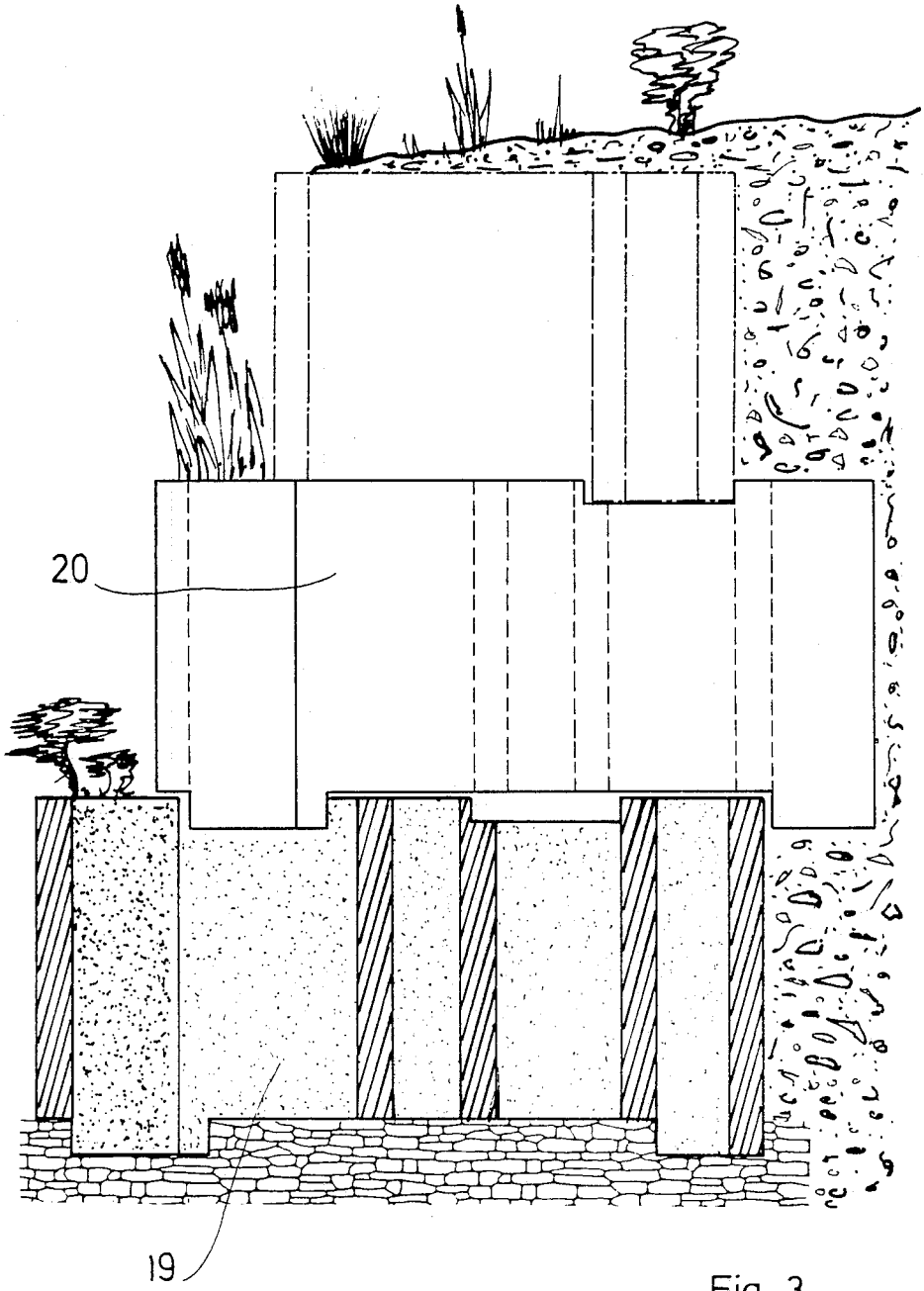
FIG. 3 is a side view showing the association of two heavy elements.

In FIG. 3, it is shown how the heavy blocks 19, 20 may be stacked on one another.

Figure 4:
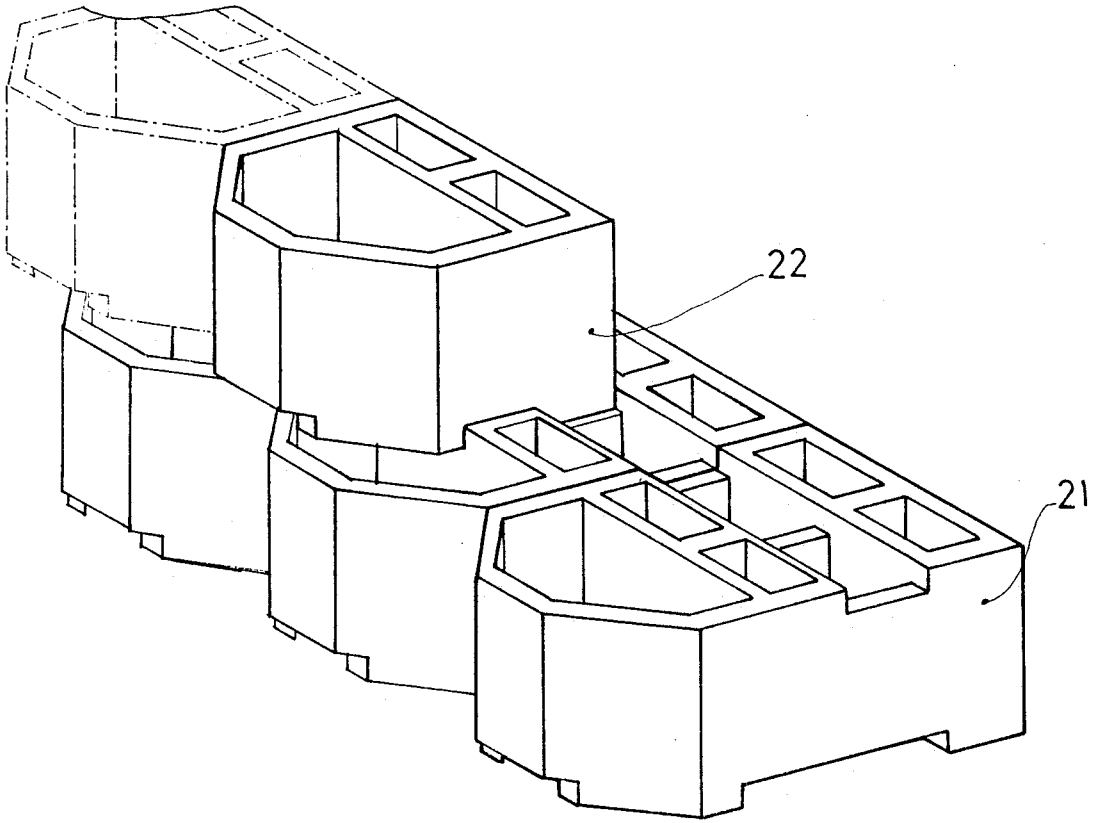
FIG. 4 is a view showing a set of light elements positioned on heavy elements.

In FIG. 4, a series of heavy blocks forms the base of the retaining wall where the lighter blocks or elements 22 are stacked on the heavy elements 21 at the top of the wall, thereby to lighten the assembly and contribute to improved stability.

Figure 5:
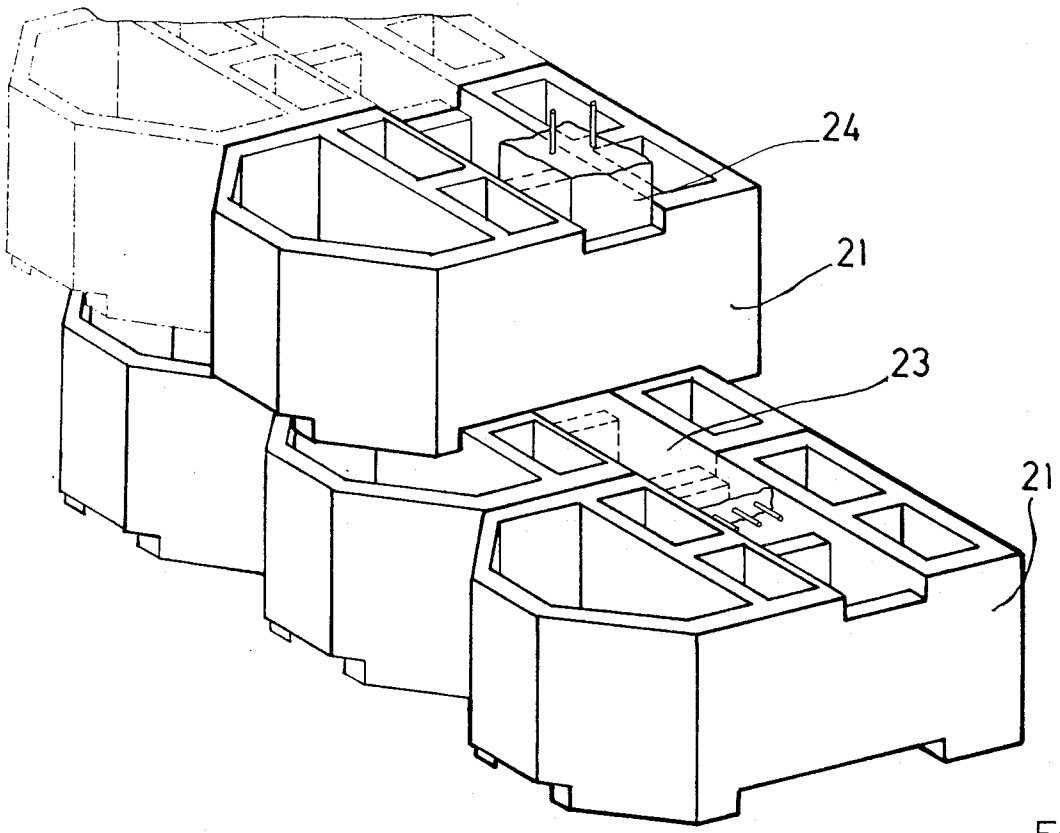
FIG. 5 is a view showing a set of heavy elements assembled on top of one another, where the special cavities are used as a concealed framing for positioning a reinforced or non-reinforced horizontal beam or pillar.

In FIG. 5 there is shown reinforcing members which may be reinforced concrete beams 23 or reinforced or non-reinforced concrete pillars 24.

These reinforcing members, or pillars or reinforced or non-reinforced beams 23, 24 may be used where extreme pressure so requires. These beams 23 or pillars 24 are positioned in the special cavities 11, 12, which serve as a concealed framing for concrete. The beam 23 uses the recess formed by the notch 10.

Figure 6:
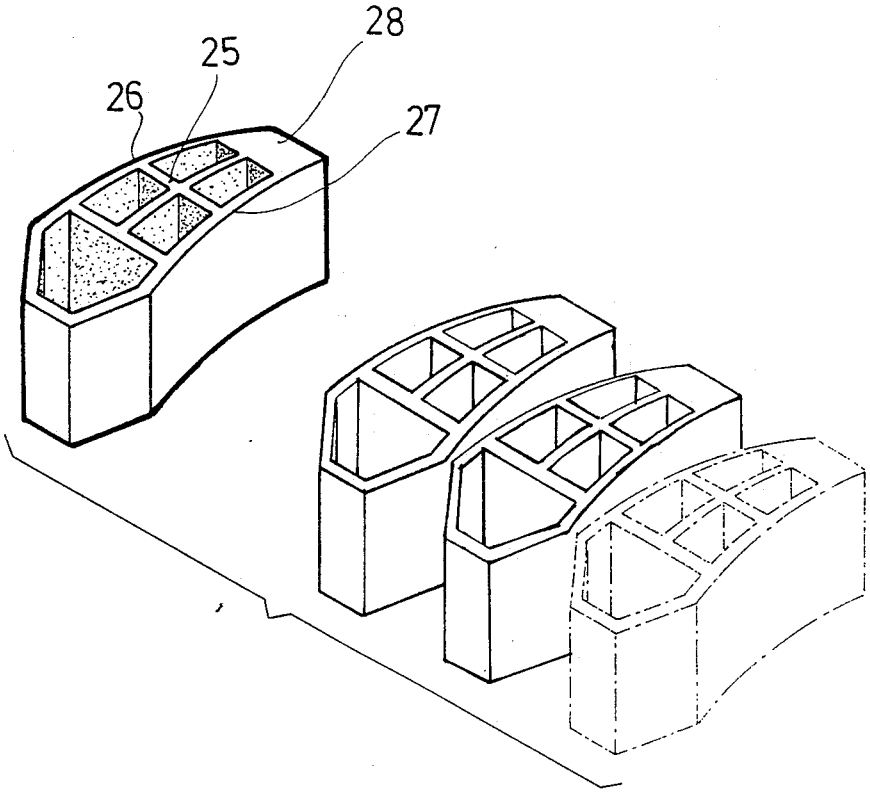
FIG. 6 is a perspective view of several heavy elements interassembled, for example, to reinforce a river bank. This

In FIG. 6 is shown a perspective view of several elements 25, which permit manufacture of curves. The longitudinal walls 26, 27 form two parallel curves. The rear portion 28 may be solid. With respect to the parallelepiped element, the curve element 25, permitting the construction of curves, will have a height less than the value of the notches situated in the base portion.

Figure 1:
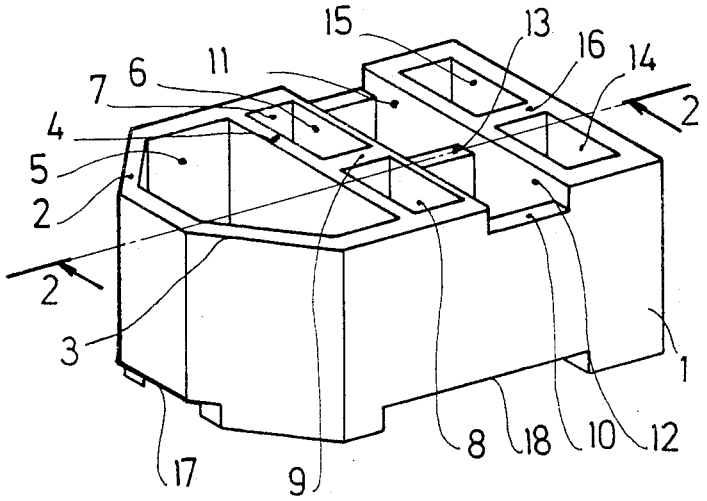
FIG. 1 is a perspective view of a heavy element according to the invention.
Figure 2:
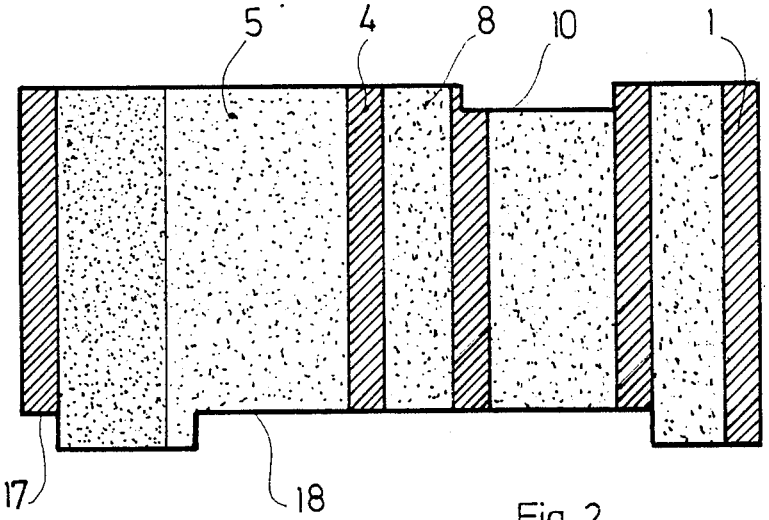
FIG. 2 is a view in section along the line A—A shown in FIG. 1.
Figure 7:
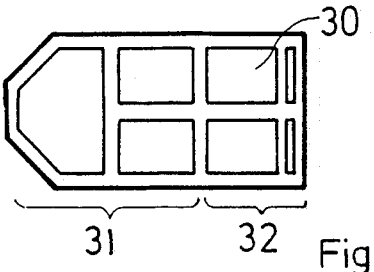
FIG. 7 is a plan view of a heavy element, without any notch between the light element and the complementary element.
Figure 8:
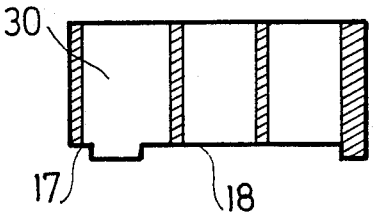
FIG. 8 is a sectional view of the construction element shown in FIG. 7.
Figure 9:
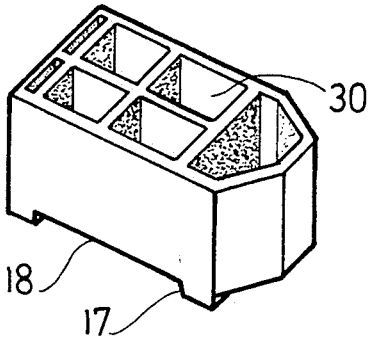
FIG. 9 is a perspective view of the heavy element shown in FIG. 7.
Figure 10:
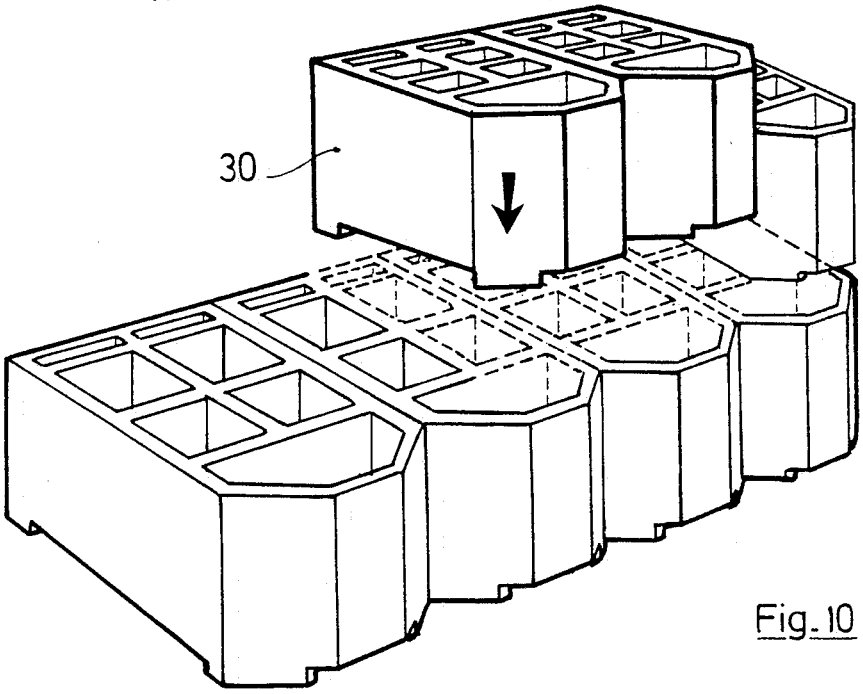
FIG. 10 is a perspective view of a retaining wall construction with the elements shown in FIG. 7.

In FIGS. 7, 8 and 9, there is shown a heavy element 30. This heavy element is composed of a so-called light element 31 and a complementary element 32. The essential difference with the heavy element shown in FIGS. 1, 2, 3 resides in the fact that this element does not comprise the notch 10.

This element also comprises an interconnecting means such as the forward notches 17 and notch 18. The significance of this embodiment is that the empty heavy element may weigh about 20 kilos, whereas full it may weigh about 50 kilos.

This element permits construction of retaining walls of at least 10 meters.

The advantages of this heavy element are as follows:

continuity with the soil, distribution of forces, reduced constraints with the soil overlapping system, one pressure compensating another pressure.

intermeshing of the heavy elements: the rigidity of the assembly is assured; any forward or rearward sliding is impossible.

superposition of the cavities guarantees rapid and sustained growth of vegetation.

totally dry mounting preventing the creation of pockets of water detrimental to the stability of the structures.

Figure 11:
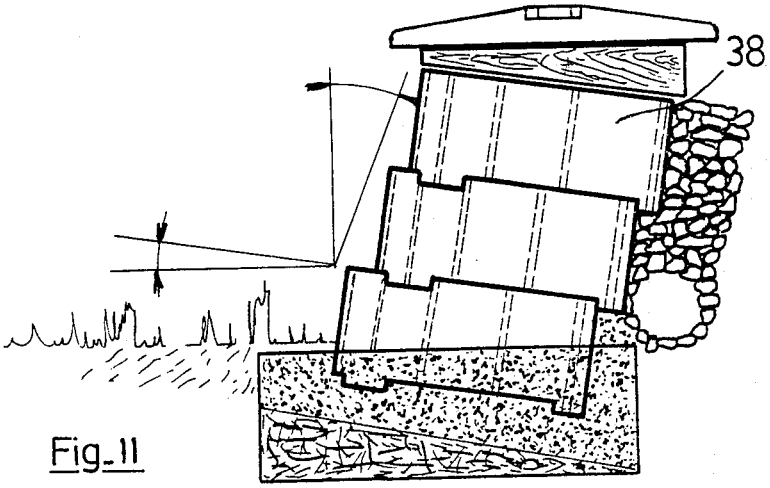
FIG. 11 is a view showing a retaining wall where the elements are rearwardly inclined, either to resist the forces from the rear, or to follow the slope of the natural terrain.

According to the possible rearward pressures and forces, it is sometimes necessary to incline the heavy elements 30 rearwardly, as shown in FIG. 11. This mounting may also be effected if it is desired to follow the natural slope of the terrain.

Figure 12:
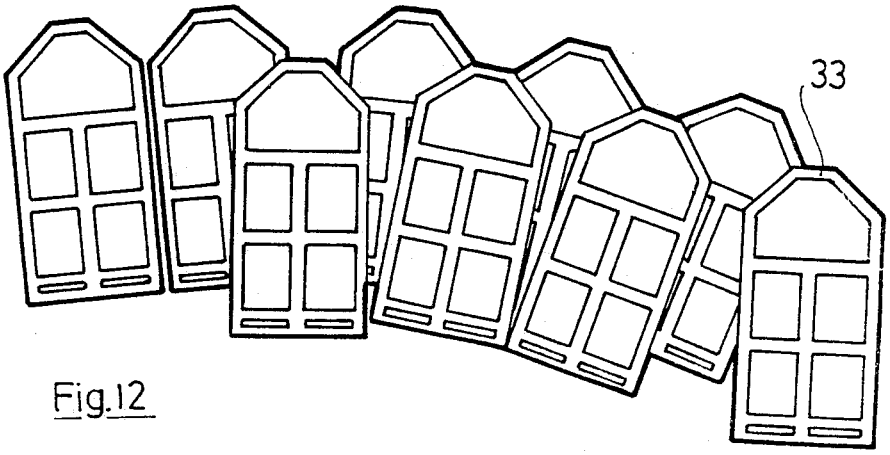
FIG. 12 is a plan view of a retaining wall where the elements form an angle relative to one another; to this end, there is no intermeshing of the elements from below, but from above where there is a hooking means such as an upper notch in the forward truncated portion.
Figure 13:
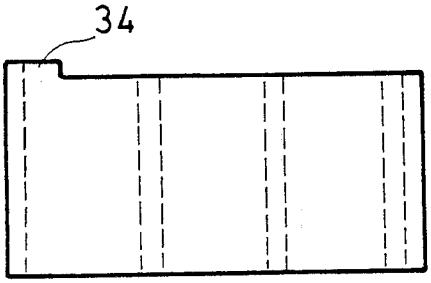
FIG. 13 is a side view of a construction element used for the retaining wall shown in FIG. 12.

FIGS. 12 and 13 show another embodiment in which the heavy element 33 no longer comprises a forward notch 17, or central notch 18. The sole interconnecting means is a slot 34, formed as an upper slot in the truncated forward portion.

This modification of the interconnecting means permits disposing heavy elements without them being adjacent to one another, it thus permits establishing a certain angle between the different elements, as shown in FIG. 12. This disposition permits imparting certain curves to the retaining wall.

Figure 15:
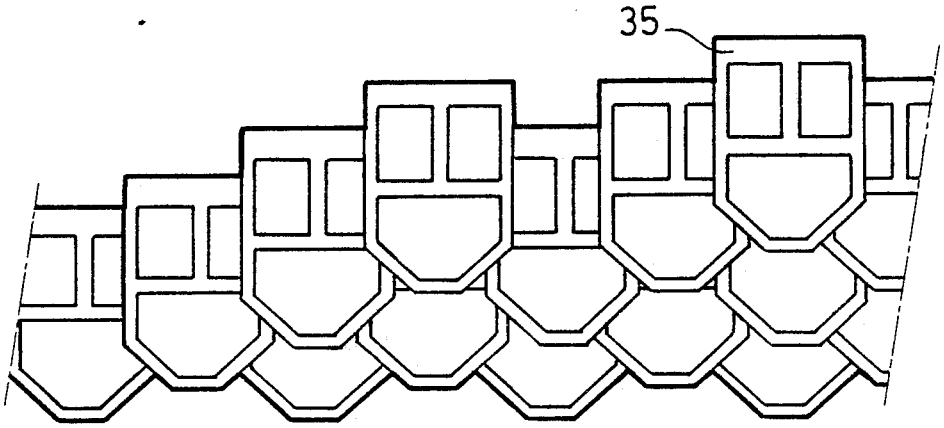
FIGS. 14, 15, 16 show.
Figure 14:
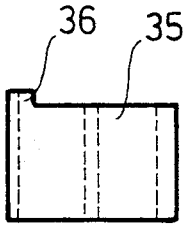
Figure 16:
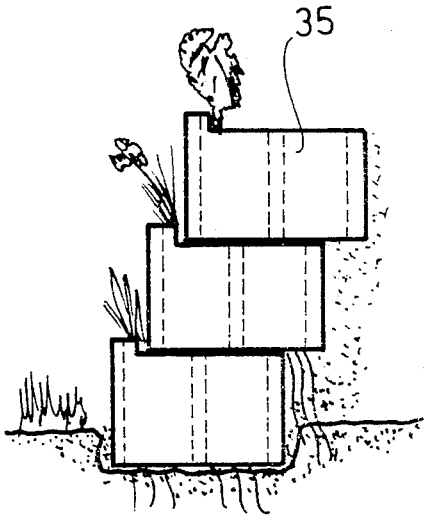

In FIGS. 14, 15 and 16, there is shown a light element 35. This light element, as the preceding heavy element, has a modification concerning its interconnecting means. The interconnecting means is an upper slot 36 in the front portion, this slot 36 permitting assembly of the retaining wall with elements which are not necessarily adjacent to one another; it permits, as shown in FIG. 15, to allow a space between the different elements 35.

FIGS. 18, 19, 20 and 21 show construction elements 29 constituted of two adjacent containers 37, 38, so-called light elements, fabricated as a single block, whose vertical side walls 39 and 40 are concave thereby to enable interassembly of these different elements. It is preferred, as shown in FIG. 21, to fill with concrete 45, possibly with reinforcing irons 41, where it is desired to build a rather high enclosing wall (see especially FIG. 18).

FIG. 17 shows a flower box in which two elements 29 have been assembled by means of a special element 42 having its vertical side walls 43 and 44 exteriorly convex.

In FIG. 19, there is shown an assembly that permits obtaining an open angle, whereas in FIG. 20, an assembly for forming a closed angle is shown.

FIG. 21 shows a privacy wall that can be provided with vegetation, whose hollow cavities, concrete-filled cavities as well as cavities for receiving vegetation, together form a vertical sound barrier.

LIST OF REFERENCES

1. Heavy element
2. 3. Angles
4. Vertical partition
5. Large space
6. Rearward space
7.8. Small spaces of the rearward space
9. Vertical partition
10. Notch 11. 12 Cavities
13. Vertical wall
14. 15. Cavities
16. Vertical wall
17. Forward notch
18. Notch
19. 20. Heavy blocks
21. Heavy blocks
22. Lighter elements
23. Beams
24. Pillars
25. Perspective of several elements
26. 27. Longitudinal walls
28. Rear portion
29. Construction element
30. Heavy element
31. Light element
32. Complementary element
33. Heavy element
34. Upper slot
35. Light element
36. Upper slot
37. Adjacent container
38. Adjacent container
39. Concave vertical wall
40. Concave vertical wall
41. Reinforcing irons
42. Special element
43. Convex vertical side wall
44. Convex vertical side wall
45. Concrete

I claim:

1. Retaining wall designed to be provided with vegetation, and constituted by dry-mounted upper and lower construction elements, by interfitting of the elements in one another, and by superposition on one another, each element comprising a bottomless container comprising vertical partitions, a first vertical partition (4), parallel to a front wall of the container, delimiting a large front space (5) which serves as a flower pot and at least one rear space (6) which serves as a root cavity for the upper container mounted recessed therefrom, offset rearwardly from the lower container, this latter space (6) being divided in at least two smaller spaces (7, 8) by a second vertical partition (9) perpendicular to the front wall and to the first partition; there being a notch (10) disposed on each upper side edge of the lower container so as to receive a downwardly projecting portion of the upper container, and means defining at least one small space (14, 15) behind said notches of said lower container so as to permit supplementary vegetation.

2. Retaining wall according to claim 1, said lower container having a vertical median wall (13) in rearward extension of the second vertical wall (9), delimiting two spaces (11, 12) which are between and below said notches and which may serve as a concealed framing for concrete; and a vertical wall (16), extending the last-named vertical wall (13) and defining two said small spaces (14, 15).

3. Retaining wall according to claim 2, wherein at the level of the lower edges of said lower element, there is a forward notch (17) and another large notch (18) in the median portion of the bottomless container.

4. Retaining wall for forming curves according to claim 1, having longitudinal side walls (26, 27) that form two parallel curves.

5. Retaining wall intended to be provided with vegetation, and constituted by dry-mounted construction elements, by superposition on one another, each element comprising a bottomless container comprising vertical partitions, a first vertical partition (4), parallel to the front wall of the container, delimiting a large front space (5) which serves as a flower pot and at least one rear space (6) which serves as a root cavity for the upper container mounted recessed therefrom, offset rearwardly relative to the lower container, this latter space (6) being divided in at least two smaller spaces (7, 8) by a second vertical partition (9) perpendicular to the front wall and to the first partition; the size of the rear spaces (7, 8) being such that when the containers are superposed on one another, the roots which exit from the upper container may pass only toward the soil and not into the lower container, each element being constituted of two adjacent containers fabricated from a single block, having two exterior vertical side walls (39, 40) which are concave.

* * * * *